United States Patent [19]

Stevens

[11] 3,940,956

[45] Mar. 2, 1976

[54] DOOR LOCK

[76] Inventor: Vincent J. Stevens, 98-15 Horace Harding Expressway, Rego Park, N.Y. 11368

[22] Filed: Oct. 23, 1974

[21] Appl. No.: 517,195

[52] U.S. Cl. ..... 70/93; 292/263; 292/264

[51] Int Cl.[2] ..... E05B 65/00; E05C 17/32; E05C 17/36

[58] Field of Search ..... 70/93; 292/263, 264

[56] References Cited

UNITED STATES PATENTS

| | | | |
|---|---|---|---|
| 373,984 | 11/1887 | Johnson et al. | 292/263 |
| 1,612,728 | 12/1926 | Johanning | 70/93 |
| 2,881,611 | 4/1959 | Callegari | 292/264 X |
| 3,274,809 | 9/1966 | Kozolowski | 292/264 X |
| 3,278,213 | 10/1966 | March | 292/263 |

*Primary Examiner*—Paul R. Gilliam
*Assistant Examiner*—Carl F. Pietruszka
*Attorney, Agent, or Firm*—Kane, Dalsimer, Kane, Sullivan and Kurucz

[57] ABSTRACT

A door lock including a first base element adapted to be mounted to a door frame and a second base element adapted to be mounted to a door. A first arm is pivotally mounted to the first base element and the second arm is pivotally mounted to the second base element. The arms are constructed so as to receive a fastener so that when the fastener is positioned in locking engagement therewith with the first base element mounted on a door frame and the second base element mounted on a door, the door will be locked to the frame with limited pivotal movement of the arms being permitted as well as the door with respect to the frame.

5 Claims, 5 Drawing Figures

DOOR LOCK

BACKGROUND OF THE INVENTION

There are many different types of door locks being employed to prevent and deter breaking and entering into an enclosure such as a residence. Certain locks employed are sometimes used as security locks for a door and permit limited opening of the door for observation purposes. Such locks would generally employ chains with some play to permit limited opening of the door. The chain is mounted at one end to the door frame and at the other end to the door. Unfastening of the chain is accomplished by means of a mechanical structure such as a sliding bolt and keyway arrangement. It has been found on occasion that this type of locking device can be relatively easily opened by extending a tool or hand through the limited opening in the door and unfastening the lock from the exterior of the door or by cutting the chain.

It would therefore be of value to have a lock of the type which can be used as a secondary lock to permit limited opening of the door for observation purposes while employing a locking arrangement which makes unfastening or breaking of the lock extremely difficult.

SUMMARY OF THE INVENTION

Thus, with the above background in mind, it is among the primary objectives of the present invention to provide a door lock which is adapted to be mounted on the inside of the door in a manner which permits limited opening of the door and which utilizes a positive locking element to deter against breaking of the lock.

Additionally, the lock includes high strength members which are difficult to break or sever and, furthermore, guard means is provided to deter anyone from easily unfastening the lock from the door frame. It is the object of the present invention to prevent or deter an intruder from breaking the integrity of the lock and entering while retaining the ability to opening the door a limited amount.

In summary, the door lock includes a first base element with means thereon for mounting the first element to a door frame and a second base element with means thereon for mounting the second element to a door. A first arm is pivotally mounted to the first base element and a second arm is pivotally mounted to the second base element. Fastener receiving means is on each arm and is adapted for reception of a fastener element in locking engagement therewith to lock the arms together when the first base element is mounted to a door frame and the second base element is mounted on the door and the arms are pivotted until the fastener receiving means on the arms are aligned. In this fashion, the door is locked to the frame with limited pivotal movement of the arms and door being permitted with respect to the frame.

With the above objectives in mind, reference is had to the attached drawings.

DESCRIPTION OF THE PREFERRED EMBODIMENTS

Figure 1:
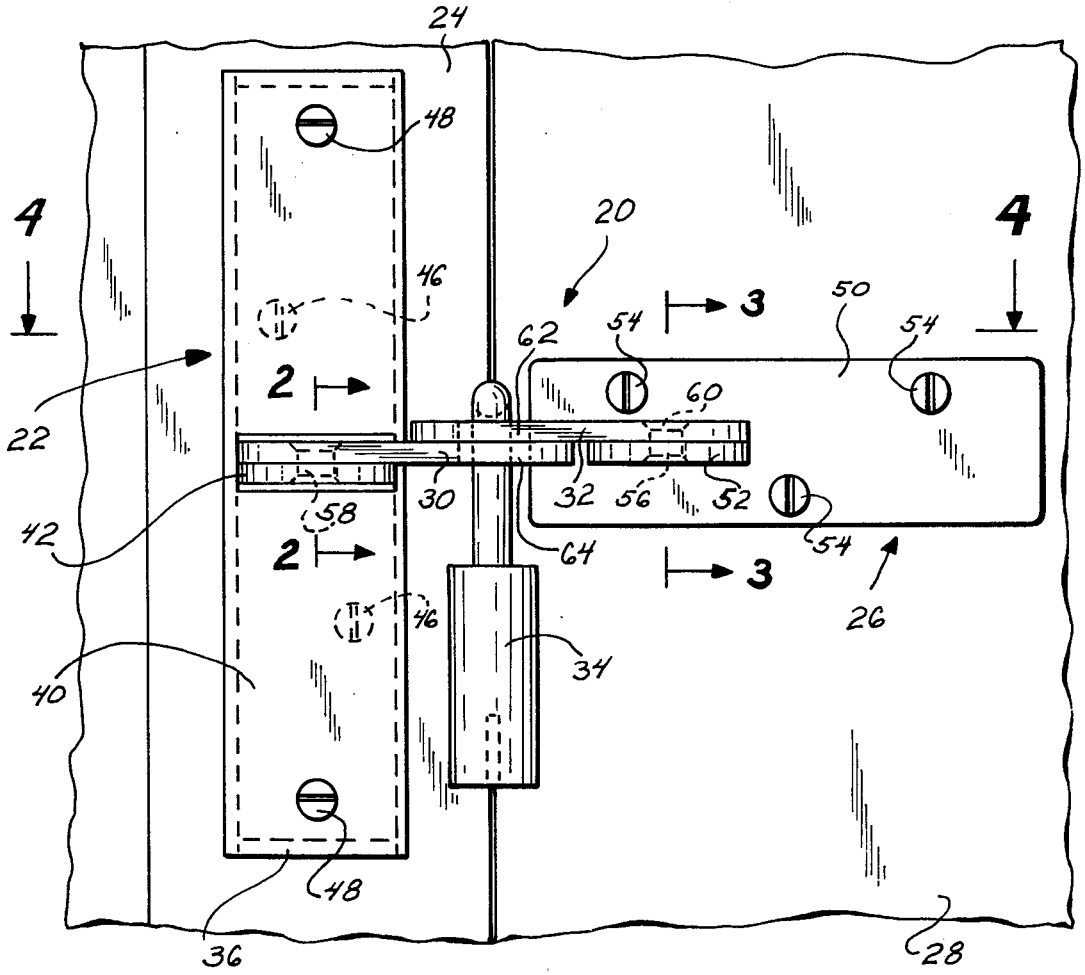
FIG. 1 is a side elevation view of the door lock mounted to a door and door frame and fastened together in locked condition.
Figure 2:
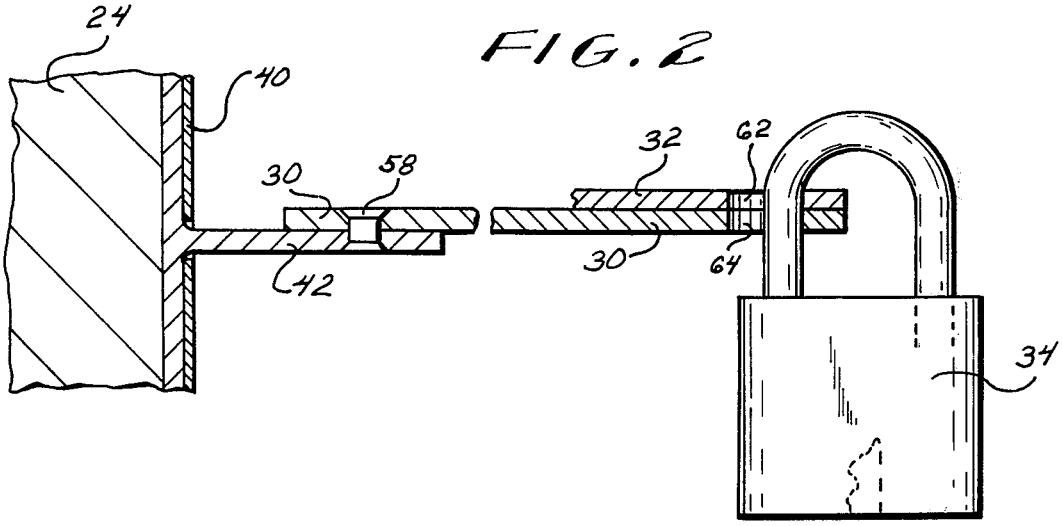
FIG. 2 is a fragmentary sectional view thereof taken along the plane of line 2—2 of FIG. 1.
Figure 4:
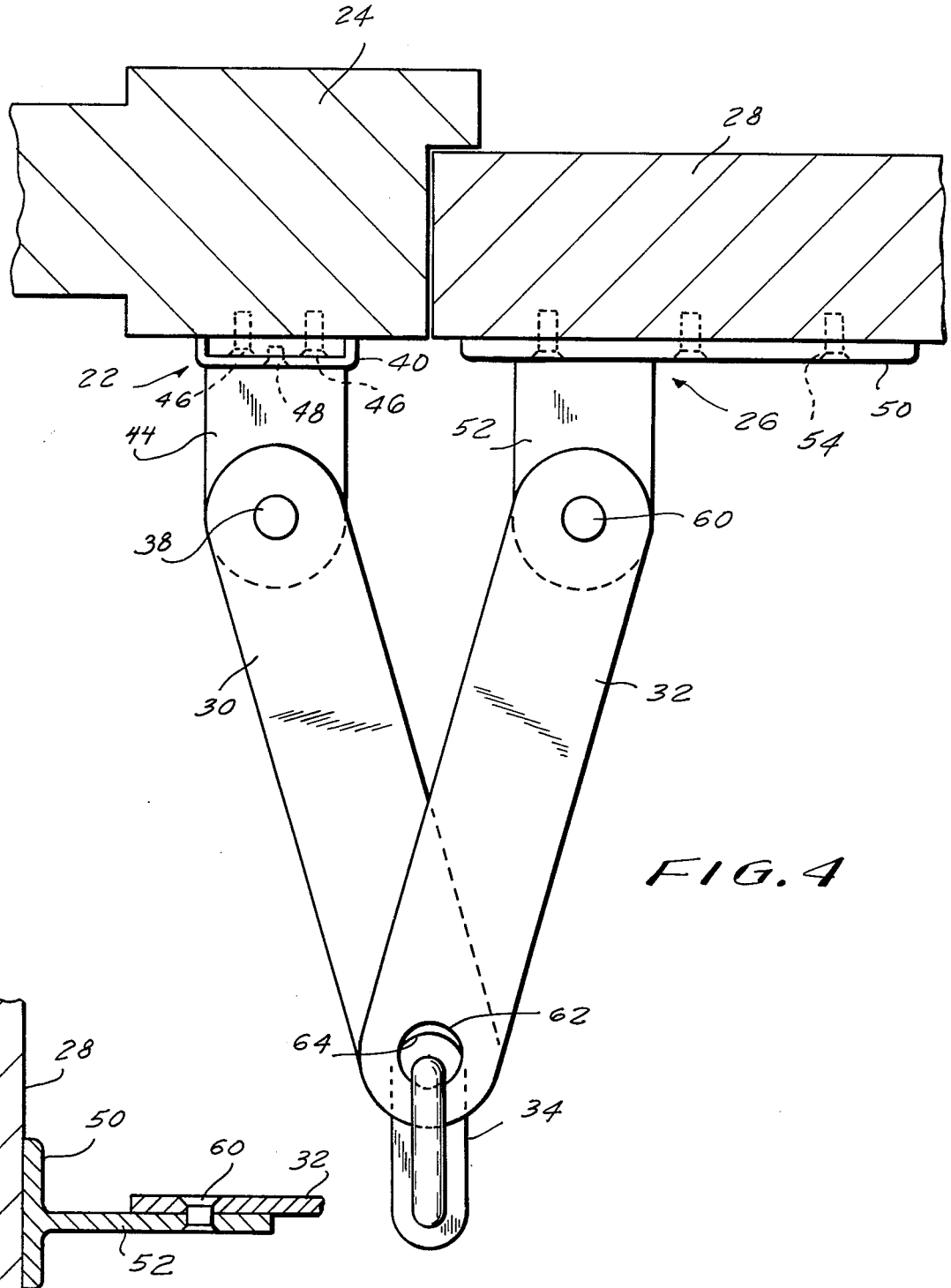
FIG. 4 is a top sectional view thereof taken along the plane of line 4—4 of FIG. 1.
Figure 3:
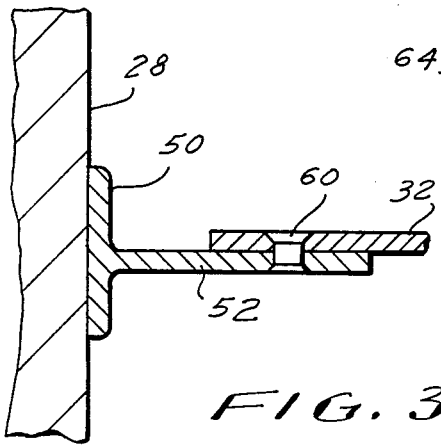
FIG. 3 is a fragmentary sectional elevation view thereof taken along the plane of line 3—3 of FIG. 1.

Door lock 20 includes a first base plate 22 to be mounted to a door frame 24 and a second base plate 26 to be mounted to a door 28. A first pivot arm 30 extends from base plate 22 and a second pivot arm 32 extends from base plate 26. A lock of a conventional type such as a padlock 34 can be used to lock arms 30 and 32 together to achieve the desired locking action.

Base plate 22 is rectangular and L-shaped in configuration with the longer leg 36 having apertures therein to receive screws for mounting the plate to the inside of door frame 24. The shorter leg then extends laterally and horizontally inwardly from door frame 24 and contains a pivot orifice 38 adjacent its free end.

A guard or cover plate 40 is provided with a slot 42 intermediate its ends. The slot 42 is large enough to receive shorter leg 44 of element 22 therethrough. In this manner, the plate can be brought adjacent to longer leg 36 so as to cover the apertures through which fasteners are employed to mount the plate to frame 24. Guard plate 40 is somewhat U-shaped in configuration so as to engage with the wall of door frame 24 with the free ends of the U-shaped plate and the plate covers the apertures and fasteners in longer leg 36. Fasteners such as screws 46 can be employed to pass through the apertures in base plate 22 to lock the fastener plate to the door frame 24 and similarly, screws 48 can be passed through appropriate apertures in guard plate 40 so as to mount the guard plate in position covering the base plate. The provision of the guard plate on top of the base plate fastened to the door frame makes it extremely difficult for an intruder to remove the lock from the door frame. It would be a very time-consuming procedure and would deter an intruder from breaking into a residence.

The second base plate 26 is composed of two legs with the first longer leg 50 being substantially rectangular in configuration and the second shorter leg 52 extending laterally therefrom so that when the longer leg 50 is mounted to door 28 the shorter leg 52 will extend substantially horizontally into the room or enclosure being protected. The longer leg 50 contains appropriate apertures for receipt of fastener element such as screws 54 to mount the base element 26 in fixed position on the inside of door 28. Adjacent to the free end of shorter leg 52 is an aperture 56. Base element 26 as well as base element 22 is constructed of a high strength rigid material such as steel.

The arms 30 and 32 are pivotally mounted to the base elements with arm 30 having an appropriate aperture to be placed in alignment with aperture 38 of base element 22 so as to receive a pivot pin or rivet 58 therethrough to pivotally mount the arm 32 to base element 22 at the point where the aperture in the arm 30 is aligned with aperture 38 in base element 22.

With arm 30 being pinned at one end by rivet 58 it retains only freedom of angular movement. Arm 32 is fastened in a similar manner to shorter leg 52 of base plate 26. An appropriate aperture is adjacent one end of arm 32 for alignment with aperture 56 in shorter leg 52 so that a pivot pin or rivet 60 can be passed through the aligned apertures and fastened the arm to the base element 26. Similar to the freedom of arm 30, arm 32 can angularly pivot with respect to the base element while other movement of the arm is restricted.

Arms 30 and 32 are of sufficient length so that they will overlap at their free ends. Arm 32 has an opening 62 adjacent its free end and arm 30 has a similar opening 64 adjacent its free end. Therefore, when arms 30 and 32 are overlapped, apertures 62 and 64 can be aligned to permit passage of a fastener therethrough to lock the arms together. As shown, the locking arm of padlock 34 is passed through openings 62 and 64 in FIGS. 1–4 to show the lock 20 in locked condition. In the locked condition, arms 30 and 32 retain pivotal movements to a limit degree about their respective pivot pins 58 and 60 so as to permit a limited opening of the door. The amount which the door may be opened is dependent upon a number of parameters such as the length of arms 30 and 32. Arms 30 and 32 are constructed of a high strength material such as steel and are of sufficient cross-section to prevent ease of rupture of the arms and consequent entry by an intruder. It should be kept in mind that while steel is described as an acceptable material for the components of lock 20, it can be readily envisioned that a number of other conventional well known high strength materials can be used as a substitute for steel.

In operation, installation of the lock is accomplished by mounting base plate 22 to the door frame 24 and thereafter mounting the second base plate 26 to the inside of door 28. The mounting operations include fastening longer leg 36 to the frame by means of screws 46 and then positioning guard plate 40 over the longer leg and fastening the guard plate in position by means of screws 48. Similarly, the longer leg 50 of base plate 26 is positioned on the rear surface of door 28 in proper alignment with base plate 22 and is fastened in position by means of screws 54. Thereafter, arms 30 and 32 are pivoted into overlapping position with apertures 62 and 64 in alignment. Padlock 34 is then passed through the apertures and locked thereby preventing access to the interior of the room.

Figure 5:
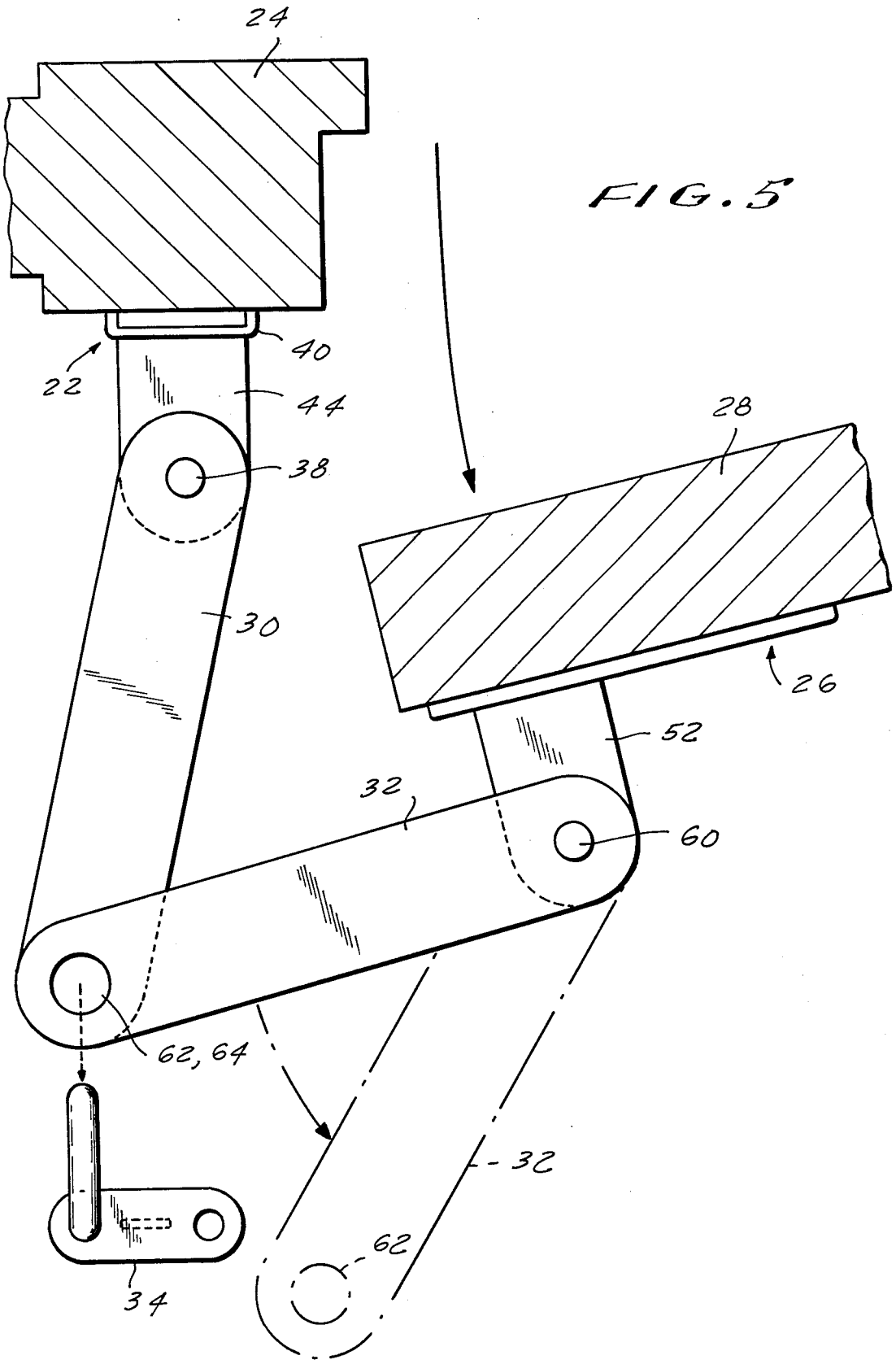
FIG. 5 is a top sectional view thereof with arrows showing the sequence of opening the door to the limited amount, removing the fastener, and disconnecting the lock to permit complete opening of the door.

The steps required for opening of the lock and the door is depicted in FIG. 5. Initially, door 28 is open the permitted amount to permit the proper party to reach within and unlock padlock 34. Arms 30 and 32 are then free to be pivoted away from each other permitting full opening of the door.

Thus the several aforenoted objects and advantages are moste effectively attained. Although several somewhat preferred embodiments have been disclosed and described in detail herein, it should be understood that this invention is in no sense limited thereby and its scope is to be determined by that of the appended claims.

I claim:

1. A door lock comprising:

a first base element of high strength, rigid, unitary material and being of thick cross section;

the first base element being L-shaped in configuration with one leg being adapted for fastening the element to the inside of a door frame and the other leg of the first base element extending substantially perpendicular therefrom and having a pivot orifice therethrough;

a second base element of high strength, rigid, unitary material and being of thick cross section;

the second base element being L-shaped in configuration with one leg adapted to be fastened to the inside surface of a door adjacent the door frame;

the other leg of the second base element extending substantially perpendicular to the first leg thereof and having a pivot orifice therethrough;

a first arm of high strength, rigid, unitary material and being of thick cross section and having a pivot orifice adjacent one end thereof adapted to be aligned with the pivot orifice in the other leg of the first base element so as to receive a pivot pin inserted through the aligned openings whereby the first arm is free to pivot with respect to the rigidly mounted first base element;

a second arm of high strength, rigid, unitary material and being of thick cross section and having a pivot orifice adjacent one end thereof adapted to be aligned with the pivot orifice in the other leg of the second base element so as to receive a pivot pin through the aligned orifices thereby pivotally attaching the second arm to the second base element;

fastener receiving surfaces in the end of each arm distal from the pivot orifice therein and the arms being of predetermined rigid length and being of sufficient thickness to resist breaking and the fastener receiving surfaces adapted to be aligned with one another for receipt of a fastener element and locking thereof; and a fastener element adapted to be removably fastened to the fastener receiving surfaces on the arms so as to rigidly interconnect the arms and lock the door to the door frame while permitting limited movement of the door with respect to the door frame upon pivotal movement of the interconnected arms so that the door can be partially opened and a person from outside of the enclosure can reach the fastener and unlock the fastener and permit the arms to be displaced from one another and the door to be opened and the high strength, rigid, unitary material of thick cross section of the arms and base elements substantially hindering a person from breaking or cutting the lock.

2. The invention in accordance with claim 1 wherein the fastener receiving means are a fastener orifice in the end of each arm distal from the end containing the pivot orifice and the fastener element being a padlock adapted to be passed through the orifices of the two adjacent arms when the fastener orifices therein are aligned.

3. The invention in accordance with claim 1 wherein the first base element includes guard means mounted thereon to facilitate prevention of access to the means mounting the first element to the door frame, the guard means including a U-shaped plate having a slot therein to receive the other leg of the L-shaped first base element therethrough and to be brought into position covering the leg of the base element containing the means for interconnecting the leg of the base element with the door frame, and means on the guard plate for removably mounting the plate in guard position after the first base element has been mounted to the door frame thereby preventing ready access to the means holding the first base element to the door frame.

4. The invention in accordance with claim 1 wherein the door lock is of steel material.

5. The invention in accordance with claim 1 wherein the arms are rectangular in cross section with the longer dimensioned side being substantially horizontal when the lock is mounted to the door and door frame thereby increasing the difficulty to sever the arms.

* * * * *